US005449971A

United States Patent [19]

Scott et al.

[11] Patent Number: 5,449,971

[45] Date of Patent: Sep. 12, 1995

[54] METHOD, COMPOSITION, AND MEANS FOR LIMITING LEAD WIRE ARCING IN AN ARC DISCHARGE LAMP

[75] Inventors: Curtis E. Scott; Harihar D. Chevali, both of Mentor, Ohio

[73] Assignee: General Electric Company, Schenectady, N.Y.

[21] Appl. No.: 113,036

[22] Filed: Aug. 31, 1993

[51] Int. Cl.[6] ..... H01J 61/56

[52] U.S. Cl. ..... 313/631; 315/73

[58] Field of Search ..... 313/631, 633, 315–318, 313/231.11–231.71, 262, 331–333; 315/74, 291, 297, 300

[56] References Cited

U.S. PATENT DOCUMENTS

| | | | |
|---|---|---|---|
| 4,143,301 | 3/1979 | Strauss et al. | 315/73 |
| 4,237,403 | 12/1980 | Davis | 315/98 |
| 5,034,656 | 7/1991 | Yu et al. | 313/579 |
| 5,126,636 | 6/1992 | Masaki | 315/291 |
| 5,264,988 | 11/1993 | Masaki | 361/10 |

*Primary Examiner*—Stephen Brinich

*Attorney, Agent, or Firm*—Stanley C. Conwin

[57] ABSTRACT

A material is provided on the lead wires that support a filament of a fluorescent lamp assembly to inhibit arcing associated with filament burnout. The material comprises a glass that is non-alkaline. Another preferred arrangement is to incorporate a material into the assembly that will release an arc inhibiting gas in response to arcing of the lead wires. For example, a calcium carbonate or strontium carbonate material releases carbon dioxide to terminate undesired lead wire arcing.

19 Claims, 1 Drawing Sheet

METHOD, COMPOSITION, AND MEANS FOR LIMITING LEAD WIRE ARCING IN AN ARC DISCHARGE LAMP

BACKGROUND OF THE INVENTION

This invention pertains to the art of arc discharge lamp assemblies and more particularly to low pressure fluorescent lamp assemblies that use a high voltage provided by an electronic ballast. The invention is particularly applicable to limiting the arcing associated with a filament or cathode of the lamp assembly burning out and will be described with particular reference thereto. However, it will be appreciated that the invention has broader applications and may be advantageously employed in other environments and applications.

One particular type of arc discharge lamp is a fluorescent lamp that is generally comprised of a sealed glass tube containing a low pressure gas. Normally the gas is a mixture of an inert gas with another substance, such as mercury. Electrode pairs are disposed at opposite ends of the tube and current is supplied to a filament that bridges each of the electrode pairs. Typically, the electrical current supplied to the fluorescent lamp is relatively low and the electrode pairs defining the cathode have an electron emissive material coated thereon. The electrons supplied by the cathode maintain an arc discharge through the gas, and the anode receives the charged particles to complete the circuit. The low pressure gas that fills the glass tube between the cathode and anode undergoes ionization as a result of the arc. For example, typically, the mercury is excited and radiates primarily at 256 nm, an ultraviolet radiation, which in turn excites a luminescent coating, such as phosphor, provided on the interior surface of the glass tube.

An initial voltage is applied across the tube to start a discharge between the cathode and anode. In prior, well known arrangements, a voltage on the order of 400 volts is typical to start the ionization process. In more recent lamp constructions, higher voltages on the order of 800 to 900 volts are now used and provided by an electronic ballast, so called instant start ballasts.

Presently, glass is used to support the cathode lead wires. The support glass is made of a hard glass such as a boro-silicate composition which contains sodium. When the arc burns the lead wire back to the glass support, the sodium enhances the discharge process. It has thus been deemed desirable to limit or preclude the arcing of the lead wire upon failure of the filament or cathode because of undesirable characteristics that result.

SUMMARY OF THE INVENTION

The present invention contemplates a new and improved assembly and method for limiting arcing associated with filament or cathode burnout in a simple, economical manner.

According to the present invention, a material is placed on the lead wires at a region spaced from the filament to release an arc inhibiting gas in response to arcing of the lead wires.

According to a more limited aspect of the invention, the material is a glass bead that releases $CO_2$ in response to arcing of the lead wires.

According to another aspect of the invention, undesirable arcing of the lead wires is limited by using a non-alkaline glass to support the lead wires.

A principal advantage of the invention resides in the ability to limit lead wire arcing and undesirable characteristics associated with arcing at the end of lamp life.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 1:
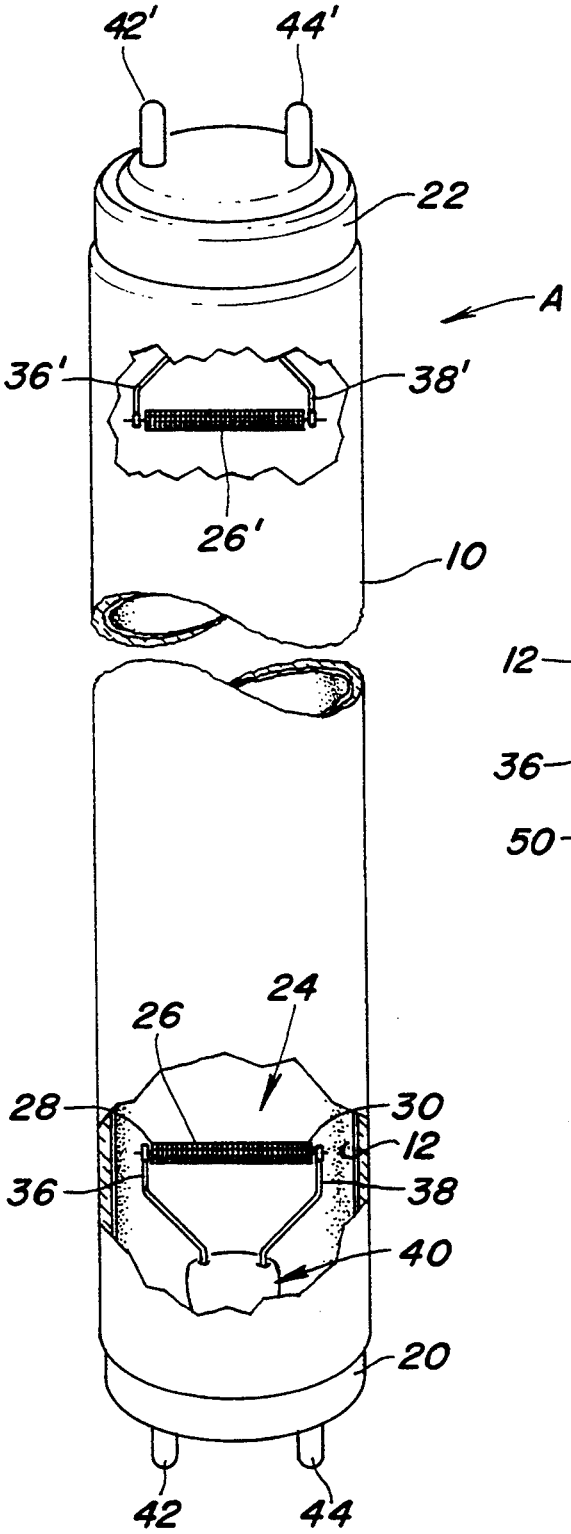
FIG. 1 is a perspective view partially in section illustrating various components of a fluorescent lamp assembly.

Referring now to the drawings wherein the showings are for purposes of illustrating the preferred embodiments of the invention only and not for purposes of limiting same, the Figures show an arc discharge lamp, such as a fluorescent lamp A, particularly of the type known as an instant start lamp in which an electronic ballast (not shown) provides a high voltage on the order of 800 to 900 volts to initiate the discharge process.

More particularly, the low pressure fluorescent lamp assembly includes an envelope such as an elongated glass tube 10 that has a luminescent coating 12 on its interior surface. For example, the coating may be a phosphor based coating applied to the interior surface of the tube through known methods. At opposite ends of the glass tube are end caps 20, which are substantially identical in construction so that description of one is applicable to the other. Contained within an end cap is a filament assembly 24 comprised of a filament 26 supported at opposed ends 28, 30 to first and second lead wires 36, 38, respectively. The lead wires are rigidly sealed in a glass support bead 40 that permits electrical current provided from an associated external source (not shown) to reach the filament while simultaneously containing the gas vapor in the glass tube. Details of the particular assembly and method of assembling the support bead, lead wires, and filament assembly are well known in the art so that further discussion herein is deemed unnecessary to a full and complete understanding of the subject invention.

The lead wires extend through the support bead and are electrically connected to first and second contact pins 42, 44, respectively. Upon application of current to the contact pins 42, 44, the filament that defines the cathode emits electrons which assist in ionizing the gas vapor contained in the glass tube. The radiation emitted by the gas vapor, in turn, excites the luminescent coating on the inner surface of the tube. This provides the desired wavelength of visible light in a manner that achieves a high conversion of electrical power to light.

Typically, the glass 40 that supports the lead wires is formed of a hard glass such as a boro-silicate glass that contains sodium. At the end of the useful life of the lamp assembly, the filament often burns out and separates from one of the lead wires 36, 38. Since electrical current is still being supplied to the lamp assembly, arcing occurs across the gap between the filament and the lead wire from which it has been disconnected or separated. The sodium in the glass enhances the discharge. The arcing, though, at the end of the useful life of the lamp assembly is undesirable.

One preferred arrangement for addressing this problem is to use a high temperature glass for the support bead 40 which contains no alkalis, such as sodium, potassium, lithium, etc. For example, alumina, silica, or barium-based glass could be used as a substitute to meet the requirement for a non-alkaline or non-sodium glass. The omission of sodium, i.e., a glass composition devoid of sodium, will limit the arcing and the burn back to the glass support bead will be the extent of the arcing problem.

An example of a non-alkaline glass intended to limit the undesirable characteristics associated with lead wire arcing is:

EXAMPLE 1

| | percent by weight |
|---|---|
| $SiO_2$ | 60.4% |
| $Al_2O_3$ | 14.5% |
| BaO | 18.0% |
| CaO | 6.5% |
| SrO | .3% |
| $TiO_2$ | .2% |

Figure 2:
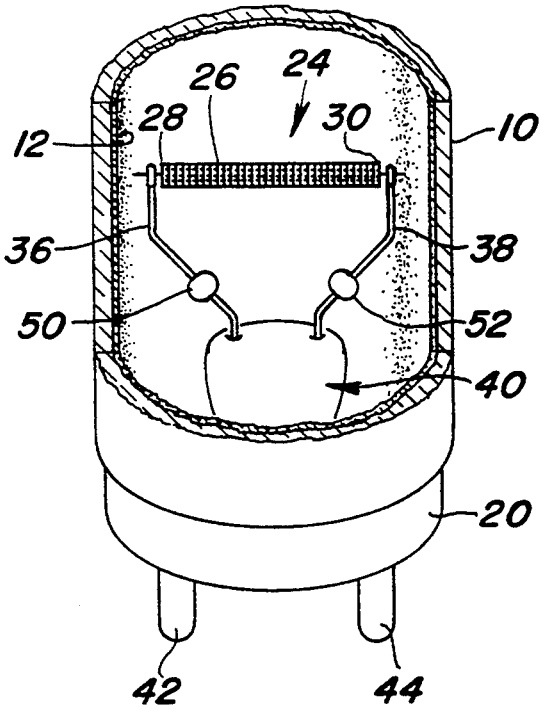
FIG. 2 is an enlarged view of a portion of FIG. 1 particularly illustrating one preferred arrangement for limiting arcing of the lead wires.

Alternatively, and as particularly shown in FIG. 2, a pair of beads 50, 52 are provided on the lead wires at an area spaced from the filament. These beads 50, 52 preferably incorporate a material that will release an arc inhibiting gas in response to arcing of the lead wires. Since the pressure and gases in the sealed lamp are carefully preselected for desired arcing to provide visible light, the release of a gas in response to the arcing of the lead wires will interfere with the lead wire arcing. For example, a material that releases $CO_2$ in response to the arcing can be used. A specific example would include a 10 to 40 percent blend of $CaCO_3$ in a lead glass frit which is processed into a glass bead and used to support the lead wires. The mix ratio of glass and carbonate can vary from 5% to 100% carbonate. Therefore, mix ratios other than that exemplified hereinabove may be used. The primary concern with the mixture is the ability to hold the bead together, the glass acting as a binder for the composition. As the carbonate levels increase over 40 weight per cent, the glassy phase provides less strength to the mixture. It is to be understood that, as the glass functions primarily as a binder, it may be replaced by any suitable means of fixing or holding the gas-releasing material in the desired configuration.

When the arc burns down the lead wire to the glass bead 50, 52, the bead will be reacted and release $CO_2$ which, in turn, will terminate the arcing. Still other materials such as strontium carbonate for higher temperature applications, or barium carbonate could be used that would release $CO_2$. Moreover, still other arc inhibiting gases such as $O_2$, CO, $SO_2$, or $H_2O$ can be used in a similar manner.

Another option is to coat the lead wires along their entire length. For example, the lead wires may be dip coated with such an arc inhibiting material. Although such an arrangement would achieve the same result, it is not deemed to be as desirable as providing separate beads as shown in the FIG. 2 arrangement.

It is also preferred that the beads be spaced from the glass support area 40 so that the hermetic sealing operation of the glass support area is not adversely affected.

Particular examples of a glass and carbonate mixture used for the beads are:

EXAMPLE 2

| 20% $CaCO_3$ composition | percent by weight |
|---|---|
| $CaCO_3$ | 20% |
| Glass* | 80% |

EXAMPLE 3

| 40% $CaCO_3$ composition | percent by weight |
|---|---|
| 40% $CaCO_3$ composition | |
| $CaCO_3$ | 40% |
| Glass* | 60% |
| $SiO_2$ | 62.8% |
| PbO | 19.8% |
| $Na_2O$ | 7.6% |
| $K_2O$ | 7.4% |
| $Al_2O_3$ | 2.1% |
| $Sb_2O_3$ | 0.3% |

*Glass composition for examples 2 and 3:

An alternative glass composition which could be used as the binder for holding the composition together is:

| | |
|---|---|
| $SiO_2$ | 56.7% |
| PbO | 28.9% |
| $Na_2O$ | 3.8% |
| $K_2O$ | 8.8% |
| $Al_2O_3$ | 1.4% |
| $Sb_2O_3$ | 0.2% |

Alternative non-lead based glasses which could be used as the binder material are:

| | percent by weight |
|---|---|
| $SiO_2$ | 70.3% |
| $Na_2O$ | 12.5% |
| $K_2O$ | 3.5% |
| BaO | 3.0% |
| $Al_2O_3$ | 2.0% |
| CaO | 6.7% |
| $Li_2O$ | 0.8% |
| $As_2O_3$ | 0.2% |
| F | 1.0% |
| or | |
| $SiO_2$ | 69.7% |
| $B_2O_3$ | 15.2% |
| $Al_2O_3$ | 4.0% |
| MgO | 0.3% |
| CaO | 0.5% |
| ZnO | 2.8% |
| $Na_2O$ | 2.8% |
| $K_2O$ | 4.4% |
| Cl | 0.3% |

As indicated above, a primary purpose of the binder or glass is to provide handling and use strength to the carbonate material. Therefore, it is preferable that the particular glass used will soften at a temperature below the decomposition point of the carbonate. For example, calcium carbonate shows signs of decomposition at temperatures in the range of 525°–550° C. Thus, the selected glass should provide strength to the bead composition for temperatures below 525°–550° C. Other carbonates, such as $SrCO_3$ and $BaCO_3$ have higher decomposition temperatures than $CaCO_3$ so that a glass having a higher softening temperature can be used.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What we claim as new and desire to secure by Letters Patent of the United States is:

1. In an arc discharge lamp assembly having a envelope containing a pressurized gas, an electrode assembly in the envelope that includes a filament mounted on terminal ends of a pair of lead wires for exciting the pressurized gas, the improvement comprising:

a material placed on at least one of the lead wires at a region spaced from the filament for limiting arcing of the lead wires when the filament burns out.

2. The arc discharge lamp assembly as defined in claim 1 wherein the material is a glass bead that releases an arc inhibiting gas in response to arcing of the lead wires.

3. The arc discharge lamp assembly as defined in claim 1 wherein the material is a glass bead disposed on the lead wires at a region adjacent the filament.

4. The arc discharge lamp assembly as defined in claim 3 wherein the glass bead includes a material that releases $CO_2$ in response to arcing of the lead wires.

5. The arc discharge lamp assembly as defined in claim 1 wherein the material includes a non-alkaline glass that supports the lead wires in spaced relation.

6. The arc discharge lamp assembly as defined in claim 1 wherein the material is devoid of sodium.

7. A method for eliminating arcing of the lead wires in an arc discharge lamp upon filament burn-out comprising the steps of supporting said filament upon a pair of lead wires; and supporting said lead wires in a non-alkaline glass bead.

8. A method for eliminating arcing of the lead wires in an arc discharge lamp upon filament burn-out comprising the steps of:

supporting the filament upon a pair of lead wires; and providing a material on the lead wires that releases an arc inhibiting gas in response to arcing of one of the lead wires.

9. The method of claim 8 wherein said material comprises a carbonate-low melting glass blend.

10. The method of claim 9 wherein said carbonate is selected from calcium carbonate, strontium carbonate, and barium carbonate.

11. The method of claim 9 wherein said low melting glass has a melting temperature below the decomposition point of the carbonate.

12. The method of claim 8 wherein said material releases $CO_2$ upon contact by said arc.

13. A composition for eliminating the discharge caused by arcing of the lead wires in an arc discharge lamp upon filament burn-out comprising a blend of a carbonate and a low melting glass which evolves an arc inhibiting gas upon contact of said composition by said arc.

14. The composition of claim 13 wherein said carbonate is selected from calcium carbonate, strontium carbonate, and barium carbonate.

15. The composition of claim 13 wherein said blend has a carbonate to glass ratio of about 10%–40%.

16. In a fluorescent light assembly having a tube containing a pressurized gas and a luminescent coating on an interior surface of the tube, an electrode assembly in the tube that includes a filament mounted on terminal ends of a pair of lead wires for exciting the pressurized gas, the improvement comprising:

a material placed on the lead wires at a region spaced from the filament for limiting arcing of the lead wires when the filament burns out.

17. The fluorescent light assembly as defined in claim 16 wherein the material is a non-alkaline glass composition used to support the lead wires.

18. The fluorescent light assembly as defined in claim 16 wherein the material releases an arc inhibiting gas in response to arcing of the lead wires.

19. The fluorescent light assembly as defined in claim 18 wherein the material includes a carbonate and the arc inhibiting gas is $CO_2$.

* * * * *